US006565972B1

(12) United States Patent
Pellerin et al.

(10) Patent No.: US 6,565,972 B1
(45) Date of Patent: May 20, 2003

(54) MULTIFILAMENT TEXTILE YARNS WITH HOLLOW SECTION, METHOD FOR MAKING SAME, AND TEXTILE SURFACES OBTAINED FROM SAID YARNS

(75) Inventors: Vincent Pellerin, Cesano Maderno (IT); Walter Roggenstein, Bad Krozinger (DE); Uwe Schaffner, Vorstentten (DE)

(73) Assignee: Nylstar, Saint Laurent Blanay (FR)

( * ) Notice: Subject to any disclaimer, the term of this patent is extended or adjusted under 35 U.S.C. 154(b) by 0 days.

(21) Appl. No.: 09/582,649

(22) PCT Filed: Dec. 23, 1998

(86) PCT No.: PCT/FR98/02857

§ 371 (c)(1),
(2), (4) Date: Sep. 29, 2000

(87) PCT Pub. No.: WO99/34040

PCT Pub. Date: Jul. 8, 1999

(30) Foreign Application Priority Data

Dec. 29, 1997 (FR) ..... 97 16833

(51) Int. Cl.[7] ..... D01F 6/00
(52) U.S. Cl. ..... 428/398; 428/336; 428/395
(58) Field of Search ..... 428/364, 395, 428/376, 398

(56) References Cited

U.S. PATENT DOCUMENTS 3,994,121 A * 11/1976 Adams ..... 57/140 R
5,698,324 A * 12/1997 Jung et al. ..... 428/395

* cited by examiner

*Primary Examiner*—N. Edwards
(74) *Attorney, Agent, or Firm*—Burns, Doane, Swecker & Mathis, L.L.P.

(57) ABSTRACT

The invention concerns a multifilament textile yarn whereof the filaments or staples have a hollow section, a method for making said hollow yarn, and textile surfaces obtained from said yarns. More particularly, it concerns a method for making multifilament yarns comprising hollow filaments obtained by melt-drawing of a polyamide composition having a yarn count less than 10 dtex for each staple and whereof the staples with hollow section have a central hollow surface representing at least 5% of the total surface in said staple transfer section. The invention is characterized in that the yarn has an USTER coefficient (U %) less than 3% and a number of staple with arc-shaped section less than 30% of the total number of staples with hollow section. The flat yarns, twisted and textured are used in particular for mixing textile surfaces, such as woven or knitted fabric.

23 Claims, 2 Drawing Sheets

Figure 1:
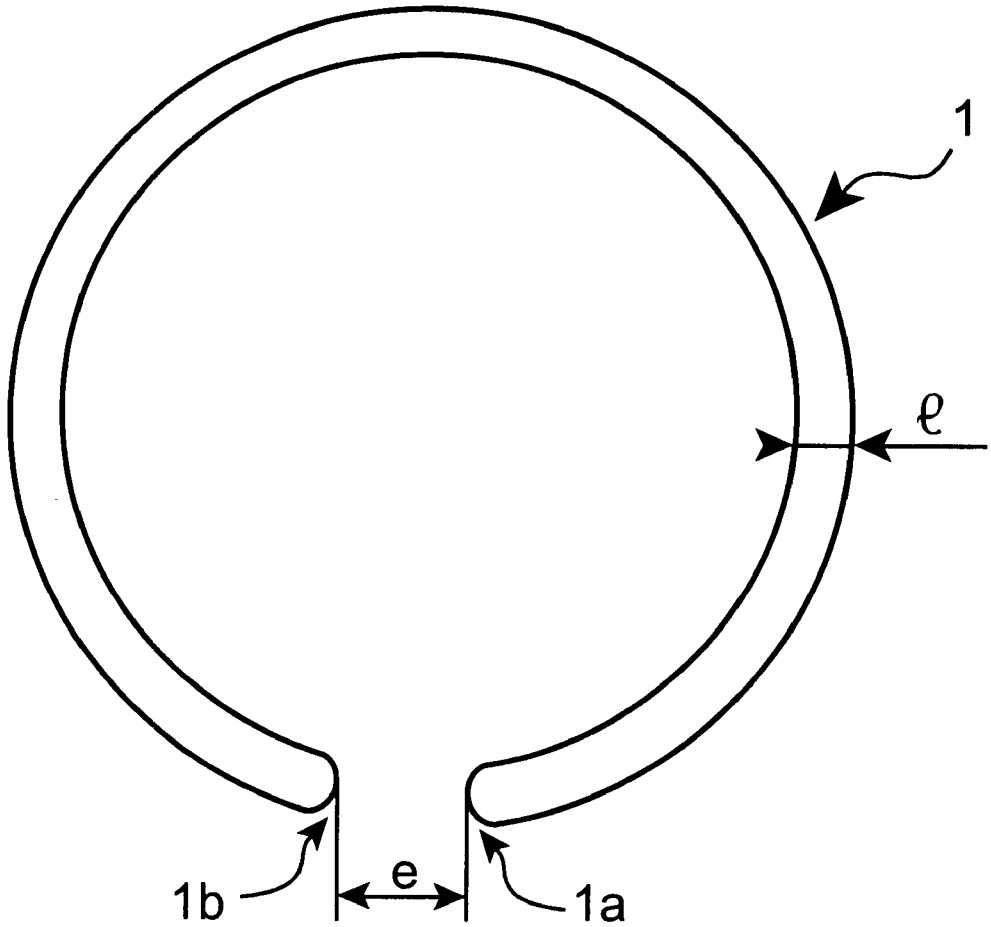

MULTIFILAMENT TEXTILE YARNS WITH HOLLOW SECTION, METHOD FOR MAKING SAME, AND TEXTILE SURFACES OBTAINED FROM SAID YARNS

The present invention relates to a multifilament textile yarn, the filaments of which have a hollow cross section, to a process for manufacturing this hollow yarn and to the textile surfaces obtained with such a yarn.

It relates more particularly to the manufacture of multifilament yarns comprising hollow filaments obtained by melt spinning a polyamide composition.

The use of hollow textile yarn in the production of textile surfaces has been sought for a very long time for producing lighter and thermally more insulating garments. However, the manufacture of filaments which include a large hollow volume and exhibit good regularity has proved to be very difficult, especially at spinning speeds and filament counts which are compatible with industrial manufacture and are suitable especially for textile applications.

A process was proposed in 1956 for manufacturing a hollow polyamide yarn. This process is described in Patent GB 843,179. It consists in spinning the polyamide in a spinneret which includes spinneret holes in the form of just one circular arc, the ends of the said arc being separated by a distance of between 0.05 and 0.3 mm.

That patent describes the manufacture of nylon-6 filaments obtained at a spinning rate of 700 m/min. The filaments are then subjected to a drawing step in order to obtain the desired count.

The spinning rate is very low compared with the rates of current industrial processes which are often greater than 3000 m/min. Furthermore, in the current processes the drawing step is often integrated into the spinning, without intermediate reworking of the filaments.

A process for obtaining polyamide filaments with a hollow cross section by a high-speed (greater than 1500 m/min.) spinning process has also been proposed in Patent Application WO 95/25188. However, this process requires the spinning of a polyamide with a high viscosity ($V_R$ greater than 50 and preferably greater than 60). Such a viscosity is high compared with that of the polyamides employed for the manufacture of conventional textile yarns, which is generally less than 50. That document specifies that the production of hollow filaments according to the process described is impossible with a polyamide of $V_R$ less than 50. Thus, the process described in that document requires an additional step in order to increase the viscosity of the polyamide, for example by postcondensation or by using catalysts. The spinneret used in that document has spinneret holes consisting of several (at least 2) circular arcs, the ends of which are a small length apart.

One of the objects of the present invention is to propose a multifilament textile yarn, the filaments of which have a hollow cross section, the yarn being obtained by a spinning or spinning-drawing process which has the advantages of the current industrial processes for spinning filaments with a solid cross section, namely productivity and regularity of the properties of the yarn, by using a polyamide of $V_R$ similar to that of the polyamides used in the manufacture of textile yarns.

For this purpose, the invention proposes a multifilament polyamide textile yarn having a filament count of less than 10 dtex and the filaments of which have a hollow cross section comprising a central empty area representing at least 5% of the total area of the cross section of the said filament, characterized in that the yarn has an Uster coefficient (U %) of less than 3% and the number of filaments having a cross section in the form of a circular arc is less than 30% of the total number of filaments having a hollow cross section.

The term "filament having a hollow cross section" should be understood to mean all the filaments obtained from a spinneret hole in the form of a circular arc, as will be described below. In other words, the hollow filaments are those whose cross section is in the form of an open or closed ring.

According to the invention, the multifilament yarn has a U % of less than 2%, preferably less than 1%.

Furthermore, the number of filaments in the form of a circular arc is advantageously less than 20%, preferably less than 10%, of the total number of filaments having a hollow cross section.

The term Up or Uster coefficient is representative of the regularity of a continuous yarn. Thus, this coefficient is determined by measuring the variations in the count of a continuous yarn on an Uster machine (Zellweger).

In order to carry out this measurement, the yarn maintained under a certain tension runs at a constant speed between the plates of a capacitor, the variation in the dielectric element formed by the yarn, due to variation in mass of the yarn, causes a variation in the capacitance of the capacitor, which is translated into the irregularity in the yarn count.

A graph showing the irregularities in the count or variation in mass along the yarn is plotted, the Uster coefficient (U %) representing the mean variation in mass, expressed as % of the mean mass.

According to another preferred characteristic of the invention, the percentage of empty area in the cross section of the filaments is greater than 10%, preferably greater than 15%, of the cross section of each filament. Advantageously, this value is between 15 and 50%.

According to another characteristic of the invention, the multifilament yarn is obtained by spinning, using a spinneret, a polyamide-based composition having a relative viscosity $V_R$ of greater than 40 and preferably between 40 and 55, advantageously between 40 and 50.

The relative viscosity $V_R$ of the polyamide is determined on an 8.4% polymer solution in formic acid.

The polyamide suitable for the invention is chosen from the group advantageously comprising nylon-6, nylon-6,6, polyamide blends comprising at least 80% by weight of nylon-6,6 or nylon-6, and copolyamides comprising at least 80% by number of nylon-6,6 or nylon-6 units.

The yarn of the invention exhibits excellent regularity and has no open filaments or filaments with a cross section in the form of a circular arc, that is to say which have not coalesced at the spinneret exit, and avoids the problems of breakage and buckling in the downstream treatments of the yarn, such as, for example, texturizing, dyeing, weaving or knitting, as well as irregularities on the textile surfaces.

The subject of the invention is also a process for manufacturing a multifilament yarn possessing the characteristics indicated above.

According to the invention, the process for manufacturing a multifilament polyamide yarn comprising filaments of hollow cross section consists in extruding a polyamide composition through at least one spinneret comprising several spinneret holes in order to form filaments, in making at least some of the said filaments converge at a point remote from the spinneret in order to form the said multifilament yarn and then to wind up the said yarn on a reel, characterized in that each spinneret hole consists of a slot in the form of a circular arc, the ends of which are separated by a length at most equal to 5 times the mean width of the said slot emerging at the exit face of the spinneret, the filaments being cooled on leaving the spinneret and the yarn being wound up at a rate of greater than 3000 m/min., preferably greater than 3500 m/min.

According to another characteristic of the invention, the width of the slot forming a spinneret hole on the exit surface of the spinneret is advantageously between 0.05 mm and 0.12 mm.

According to a novel characteristic of the invention, the ends of the circular arc forming each spinneret hole are symmetrical over at least 5% of the total length of the said circular arc, preferably Over at least 15% of this total length.

The spinnerets are produced using the standard techniques, such as electrical discharge machining.

Advantageously, the density of holes on a spinneret is between 0.25 holes/cm$^2$ and 3 holes/cm$^2$.

The yarn leaving the spinneret is cooled. The distance between the start of the cooling and the exit of the spinneret is as short as possible technologically. Thus, immediate cooling at the spinneret exit may be difficult to employ since it may cause polymer to be deposited on the surface of the spinneret, which would have the consequence of breaking the filaments.

According to the invention, the cooling is obtained by a coolant chosen from the group comprising air, a non-oxidizing gas or an inert gas, such as nitrogen. Preferably, this coolant is not saturated with water vapour.

In a preferred embodiment of the invention, the coolant is air or an inert gas.

The processes for treating the yarns thus formed are those normally used for the manufacture of polyamide textile yarns. Thus, sizing compositions for improving the surface lubrication and for altering the hydrophilic or hydrophobic properties of the surface, may be applied.

Generally, these yarns are subjected to a cold-drawing or hot-drawing step, possibly in the presence of steam. This drawing is generally incorporated into the spinning process, that is to say carried out before winding up the yarn. However, without departing from the scope of the invention, the yarns may also be drawn in a drawing process independent of the spinning, by reworking the wound-up yarn.

It is also possible to intermingle the filaments in order to improve the cohesion of the yarn. This intermingling is often used before the drawing step, but it may be done during or after the latter.

Next, the polyamide yarn may be relaxed before being wound up on a reel.

The multifilament yarns of the invention may be subjected to a crimping step or a texturizing step, depending on the field of application.

Thus, these yarns may be used as flat yarn or as twisted or textured yarn, in weaving processes as warp yarn or as weft yarn, for example.

The yarns of the invention are also used for the manufacture of knitted surfaces. Such textile surfaces woven or knitted with at least one yarn of the invention are also subjects of the invention.

Figure 2:
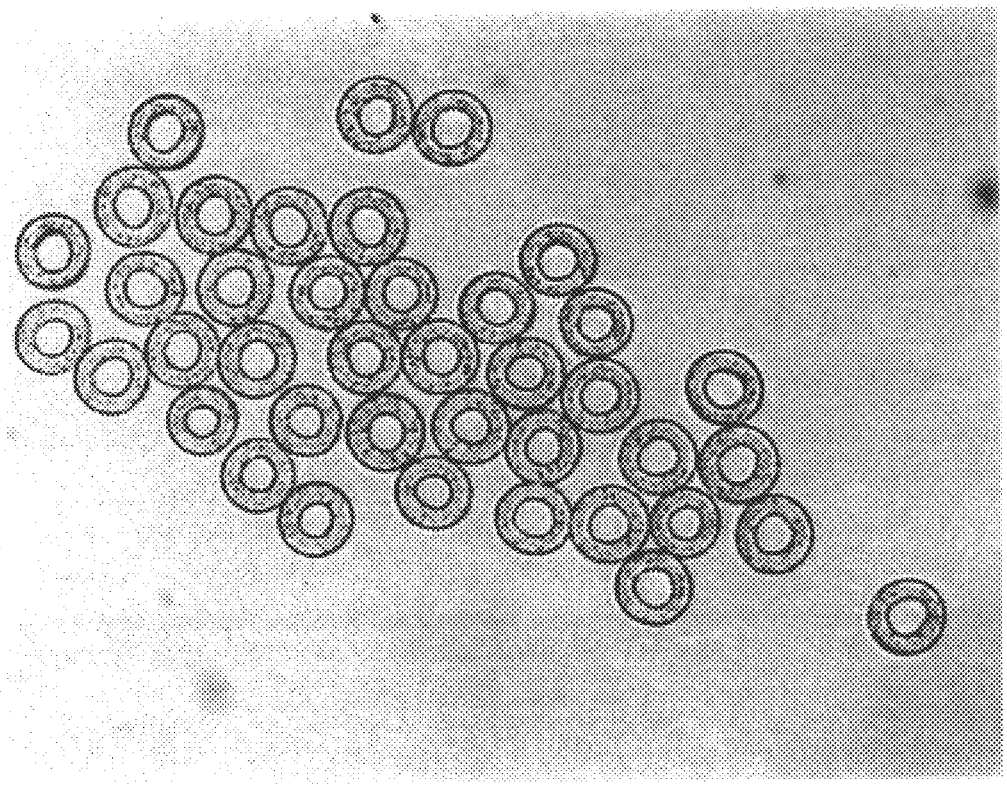

Further details and advantages of the invention will become more clearly apparent in the light of the detailed description of at least one embodiment, given purely by way of indication, with reference to the appended drawings in which:

FIG. 1 shows a schematic view of the shape of a spinneret hole according to the present invention; and FIG. 2 is a photographic sectional view of a multifilament yarn according to the invention.

EXAMPLE 1

The yarns according to the invention are obtained by spinning a composition comprising a PA-6,6 polyamide of relative viscosity $V_R$ equal to 49 and a flatting agent consisting of titanium dioxide at a concentration of 0.3% by weight.

This composition is fed into a conventional spinning device comprising a spinneret suitable for the spinning of hollow yarn.

Thus, with reference to FIG. 1, the spinneret comprises 40 spinneret holes (hole density equal to 0.8 holes/cm$^2$) having a profile 1 in the form of a circular arc of external diameter equal to 1.5 mm. The ends 1*a*, 1*b* of the circular arc are separated by a distance equal to 0.15 mm. The width 1 of the slot is regular in the example illustrated and is equal to 0.08 mm. However, this width may differ over the length of the slot without thereby departing from the scope of the invention, while meeting the symmetry characteristic of the end parts of the slot as defined above.

The spinning conditions are the following:

pressure: 250 bar temperature: 280° C.

polymer flow rate: 2.3 g/min/hole.

The filament bundle is cooled as it leaves the spinneret by a stream of coolant fed in a direction approximately perpendicular to the direction in which the bundle runs. This feed is placed at a distance of 30 mm from the exit surface of the spinneret. In the example illustrated, the coolant is air at a temperature of 22° C. Of course, the stream of coolant is fed at a rate which does not disturb the running of the filament bundle.

Next, the filaments are made to converge on a point 130 cm away from the spinneret exit. A sizing composition is deposited on the yarn thus formed, using conventional processes and devices.

Next, the yarn is wound up on a reel at a wind-up rate equal to 4500 m/min.

The yarn obtained has a total count of 165 dtex and comprises 40 filaments (165F40 yarn count).

FIG. 2, depicting a cross-sectional view of the yarn obtained, shows the hollow cross section in the form of a ring of filaments. The percentage void content is greater than 15%. The number of filaments having a cross section in the form of a circular arc, that is to say filaments whose ends have not coalesced at the spinneret exit, is equal to zero in the example illustrated.

The characteristics of the yarn obtained are as follows:

Uster coefficient (U %): 0.9 (value determined by integration)

elongation at break: 45% tenacity: 35 cN/tex $S_{BW}$ (shrinkage in boiling water): 10%

Cohesion factor (determined by the manual hook method): 15 knots/m.

A fabric was woven with yarns obtained by the process described above and having a 165F40 count. The fabric was woven on a rapier loom and subjected to a calendering operation.

An identical fabric was woven with a conventional yarn having a round and solid cross section. The weft yarn and warp yarn count is 235F34.

The properties of these two fabrics are given in the table below.

TABLE I

| Characteristics | | Fabric with yarns of the invention | Fabric with yarns of solid cross section |
|---|---|---|---|
| Grammage ($g/m^2$) | | 95 | 136 |
| Air permeability ($l/m^2/s$) | Pressure: 100 Pa | 79.8 | 72.9 |
| | Pressure: 160 Pa | 114 | 111 |
| Thermal properties $\Delta T = 10$ K G = 200 g | Thickness (mm) | 0.1872 | 0.1456 |
| | Thermal resistance coefficient ($Km^2/W$) | 0.00638 | 0.00606 |
| | Conductivity coefficient ($W/m^2K$) | 0.02834 | 0.0241 |

These tests were carried out on the ALAMBETTA T675 apparatus sold by Volta S.p.A.

These tests show that the fabric woven with the yarns of the invention has an equivalent air permeability for a grammage which is 30% less than that of a fabric woven with conventional yarns. Furthermore, the conductivity coefficient is markedly less for the fabric woven with the yarns of the invention, thus making it possible to produce more insulating garments for a lower or equivalent weight.

EXAMPLE 2

The yarns according to the invention are obtained by spinning, in an integrated spinning/drawing process, a composition comprising a PA-6 polyamide of relative viscosity $V_R$ equal to 50 and a flatting agent consisting of titanium dioxide at a concentration of 0.4% by weight.

This composition is fed into a conventional spinning device comprising a spinneret suitable for the spinning of hollow yarn identical to that used in Example 1, but having 20 holes per spinneret.

The spinning conditions are as follows:

pressure: 220 bar temperature: 272° C.

polymer flow rate: 1.75 g/min/hole.

The filament bundle is cooled as it leaves the spinneret by a stream of a coolant fed in a direction approximately perpendicular to the direction in which the bundle runs. This feed is placed at a distance of 40 mm from the exit surface of the spinneret. In the example illustrated, the coolant is air at a temperature of 20° C. Of course, the stream of coolant is fed at a rate which does not disturb the running of the filament bundle.

Next, the filaments are made to converge on a point 130 cm away from the spinneret exit. A sizing composition is deposited on the yarn thus formed, using conventional processes and devices.

Next, the yarn is wound up on a reel at a wind-up rate equal to 4500 m/min.

The yarn obtained has a total count of 78 dtex and comprises 20 filaments (78F20 yarn count).

The yarn obtained has a percentage void content greater than 15%. The number of filaments having a cross section in the form of a circular arc, that is to say filaments whose ends have not coalesced at the exit of the spinneret, is equal to zero.

The characteristics of the yarn obtained are as follows:

Uster coefficient (U %): 1 (value determined by integration)

elongation at break: 35% tenacity: 38 cN/tex cohesion factor: 10 knots/m (determined by the manual hook method).

What is claimed is:

1. Multifilament polyamide textile yarn having a filament count of less than 10 dtex and the filaments of which have a hollow cross section having a central empty area representing at least 5% of the total area of the cross section of the said filament, wherein the yarn has an Uster coefficient (U %) of less than 3% and the number of filaments having a cross section in the form of a circular arc is less than 30% of the total number of filaments having a hollow cross section.

2. Yarn according to claim 1, wherein having it has a U % of less than 2%.

3. Yarn according to claim 2, wherein having a U % of less than 1%.

4. Yarn according to claim 1, wherein the number of filaments having an open cross section or a cross section in the form of a circular arc is less than 20%, preferably less with respect to the number of filaments having a hollow cross section in the yarn.

5. Yarn according to claim 1, wherein the empty area of a hollow cross section of a filament represents at least 10% of the total cross section of said filament.

6. Yarn according to claim 1, wherein the polyamide is comprises nylon-6, nylon-6,6, polyamide blends comprising at least 80% by weight of nylon-6,6 or nylon-6, and copolyamides comprising at least 80% by number of nylon-6,6 or nylon-6 units.

7. Yarn according to claim 1, wherein the polyamide has a relative viscosity $V_R$ of between 40 and 55.

8. Yarn according to claim 7, wherein the relative viscosity is between 40 and 50.

9. Process for manufacturing a multifilament polyamide yarn according to claim 1 comprising filaments of hollow cross section, comprising extruding a polyamide composition through at least one spinneret comprising several spinneret holes in order to form filaments, making at least some of said filaments converge at a point remote from the spinneret in order to form said multifilament yarn and then winding said yarn on a reel, wherein each spinneret hole comprises a slot in the form of a circular arc, the ends of which are separated by a length at most equal to 5 times the mean the said slot emerging at the exit face of the spinneret, the filaments being cooled on leaving the spinneret and the yarn being wound up at a rate of greater than 3000 m/min.

10. Process according to claim 9, wherein the hollow area of the cross section of each filament is equal to at least 5% of the total area of the cross section of the filament.

11. Process according to claim 10, wherein the amount of hollow area is equal to at least 10% of the area of the cross section of the filament.

12. Process according to claim 9, wherein the mean width of the slot is between 0.05 mm and 0.12 mm.

13. Process according to claim 9, wherein in that the coolant for cooling the filaments beneath the spinneret comprises air and/or the an inert gas.

14. Process according to claim 9, wherein the yarn comprises at most 30% by number of filaments having a cross section in the form of a circular arc compared with the number of filaments having a closed hollow cross section.

15. Process according to claim 9, wherein the yarn has an Uster coefficient of less than 3%.

16. Process according to claim 9, wherein the ends of the circular arc forming each spinneret hole are symmetrical over at least 5% of length of the said circular arc.

17. Process according to claim 16, wherein the symmetrical ends of each circular arc have a length equal to at least 15% of the total length of a circular arc.

18. Process according to claim 9, wherein the polyamide has a relative viscosity of between 40 and 55.

19. Process according to claim 18, wherein the polyamide has a relative viscosity of between 40 and 50.

20. Process according to claim 9, wherein the polyamide comprises nylon-6, nylon-6,6, polyamide blends comprising at least 80% by weight of nylon-6,6 or nylon-6, and/or copolyamides comprising at least 80% by number of nylon-6,6 or nylon-6 units.

21. Process according to claim 9, wherein the yarn is subjected to a drawing operation before it is wound up.

22. Flat, textured or twisted yarn obtained from a multifilament yarn according to claim 1.

23. Woven or knitted textile surface obtained from at least one yarn according to claim 1.

* * * * *